United States Patent [19]

Voegelin

[11] 3,971,313

[45] July 27, 1976

[54] ATTACHING PRINTING STENCILS TO ROTARY SCREEN PRINTING PRESSES

[75] Inventor: Heinrich Voegelin, Wiler near Utzenstorf, Switzerland

[73] Assignee: Fritz Buser AG Maschinenfabrik, Wiler near Utzenstorf, Switzerland

[22] Filed: Jan. 18, 1974

[21] Appl. No.: 434,418

[30] Foreign Application Priority Data

Jan. 29, 1973 Switzerland ..... 1238/73

[52] U.S. Cl. ..... 101/127.1; 101/128.1

[51] Int. Cl.[2] ..... B41F 15/38; B41N 1/24

[58] Field of Search ..... 101/116–122, 101/127.1, 128.1, 129, 279

[56] References Cited

UNITED STATES PATENTS

| | | | |
|---|---|---|---|
| 975,471 | 11/1910 | Smith | 101/128.1 X |
| 1,330,793 | 2/1920 | Friess | 101/219 X |
| 2,600,433 | 6/1952 | Saywell | 308/187.2 |
| 2,711,935 | 6/1955 | Miles | 101/219 X |
| 3,599,565 | 8/1971 | Feier et al | 101/127.1 X |
| 3,881,413 | 5/1975 | Mitter | 101/128.1 X |

FOREIGN PATENTS OR APPLICATIONS

| | | |
|---|---|---|
| 288,446 | 3/1971 | Austria |
| 2,026,492 | 12/1971 | Germany |
| 2,202,081 | 1/1972 | Germany |

*Primary Examiner*—Edgar S. Burr
*Assistant Examiner*—R. E. Suter
*Attorney, Agent, or Firm*—Flynn and Frishauf

[57] ABSTRACT

The ends of rotary stencils are attached to an attachment ring which is coupled to a drive element on the printing press by means of a universal joint, in the form of a gimbal, so that mis-alignment of the attachment ring with respect to the drive axis of the printing press will not cause distortion of the stencil, during rotation, thus stressing the stencil and causing inaccuracies in reproduction of the pattern to be printed from the stencil. The operating elements of the universal joint, or gimbal construction is preferably protected fron ink, and contamination by means of O-rings, or the like; the connection between the universal joint and the stencil end ring is a bayonet-type cam-recess quick-release connection.

5 Claims, 2 Drawing Figures

ATTACHING PRINTING STENCILS TO ROTARY SCREEN PRINTING PRESSES

Figure 1:
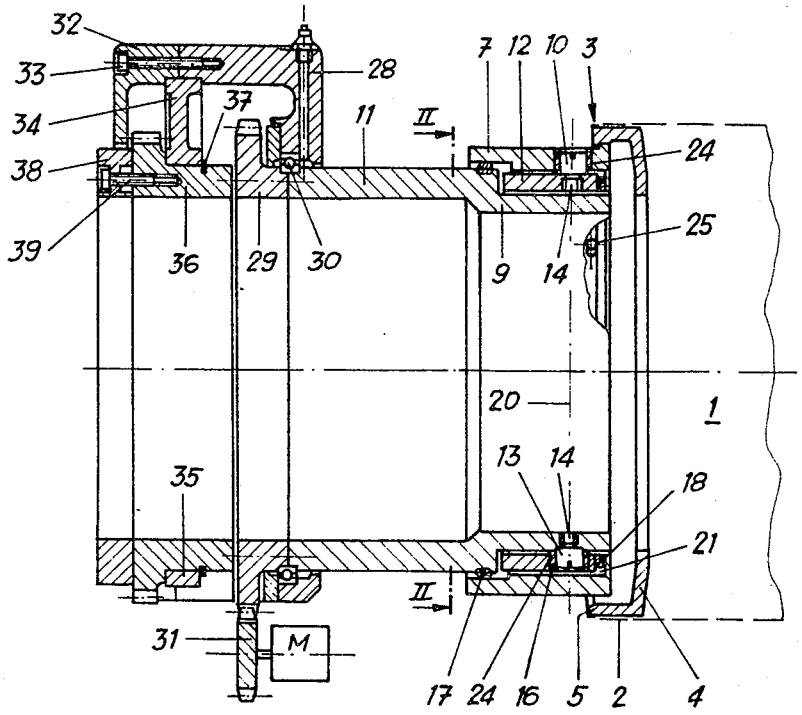

The present invention relates to the art of rotary screen printing, and more particularly to the connection between cylindrical printing stencils and the rotary drive elements of the printing presses themselves.

Stencils for use in rotary screen printing machines usually have to be removably secured to a rotary element, such as a drive bushing, or drive tube of the machine. The bushing may be tubular to introduce ink into the interior of the printing stencil.

In rotary screen printing of web-shaped material, particularly of elongated textile fabric webs or the like, it is customary to use stencils which are made by galvanic processes, such as "galvanoplast" stencils, or lacquer-type stencils. Such stencils are, for example, cylindrical grids, sieves, or screens, suitably perforated, and made of nickel, of very thin cross section. These cylinders are seamless, and are made by galvanic processes. The openings take up between 5 to 50 percent of the entire surface of the cylindrical screen stencil. To form a certain design, or composition on the stencil, the openings are wholly, or partly closed by means of photo-mechanical processes. The resulting stencil is fragile and has to be treated carefully. It is mechanically weak and subject to mechanical distortion and deformation. To provide for better mechanical stability of such a stencil and, further, to secure the stencil in a rotary screen printing machine, the stencils are usually secured to end rings, for example made of a light-weight metal alloy (aluminum, magnesium, or alloys thereof). The connection from stencil to the end rings is usually by adhesives.

The stencils are connected in the printing machines and placed under axial strain. Straining the stencils axially improves their stability and resistance to deformation and distortion. The axial strain, applied by stress in the printing machine does, however, affect the stencils undesirably by causing more or less deformation, due to the axial strain on the stencil, upon printing by the printing press. As a result, errors in exact alignment of the material or information being printed by sequential stencils on the same web may arise. Such errors particularly arise due to angular changes. The strain, placed by the printing machine, also has undesirable reaction effects on the printing press itself, resulting again in alignment errors, particularly angular shifts in alignment, and in deformation of the stencil attachment apparatus or system, which is frequently angular, or non-symmetrical with respect to the axis of the stencil. Localized additional stresses then can arise in the cylindrical stencils which may lead to premature breakage of the stencils.

It has previously been proposed to provide a flat fitting surface upon adhering the end rings to the stencil. The end rings applied to the stencil need not be identical, nor need the formation of the flat surface at the two ends be identical. Longitudinal, axial stress placed on a stencil loads the stencil unilaterally, however, thus again decreasing its operating, or life time.

Various types of holding and stretching arrangements for rotary stencils have been proposed, which are so constructed that they are intended to avoid alignment and matching errors in the material to be printed (see, for example, U.S. Pat. No. 3,599,565; or corresponding German No. 1,785,272, respectively; DT-OS No. 2,202,081 and DT-OS No. 2,026,492). The bearing bushing, or a similar part is floatingly connected, so that, upon misalignment, additional loading of the cyindrical stencil is avoided. Errors which might arise due to end rings which are not perfectly plane transversely to the axis of the stencil are not, thereby, compensated however. Known solutions cannot avoid errors which arise by end rings which are adhered, or otherwise secured to the stencils with inclination. As a result, the stencils will have a certain wobble movement, thus have non-uniform instantaneous speeds around their circumference, resulting in alignment errors if sequential patterns are to be printed on the same web of material.

It is an object of the present invention to provide a rotary screen printing press arrangement which is so constructed that cylindrical stencils can be secured thereto simply, and quickly, and which holds the stencil straight, while printing errors as a result of improperly secured end rings are avoided, and, effectively, the stencil is not stressed even though the connecting end rings are not properly secured.

SUBJECT MATTER OF THE PRESENT INVENTION

Briefly, the connecting element, such as a bearing bushing, tube or the like is secured to the end ring of the stencil by means of an intermediate universal joint, in the form of a gimbal connection, so arranged that the plane of universal movement is close to the end plane of the stencil, that is, is close to the end ring of the stencil. Ideally, the end ring and the plane of gimbal movement would be congruent; this is, however, very difficult to realize and close proximity is usually sufficient. The universal connection, in accordance with the invention, thus provides for a rotary connection between the drive bushing and the stencil in such a manner that the axis of rotation of the drive bushing and the axis of rotation of the stencil (even though the end ring may not be exactly transverse thereto) intersect practically in the plane of universal joint, or gimbal movement. Thus, inaccurate mounting of the end ring with respect to the stencil cylinder will not adversely affect transmission of rotary movement, and rotation of the stencil cylinder itself.

Figure 2:
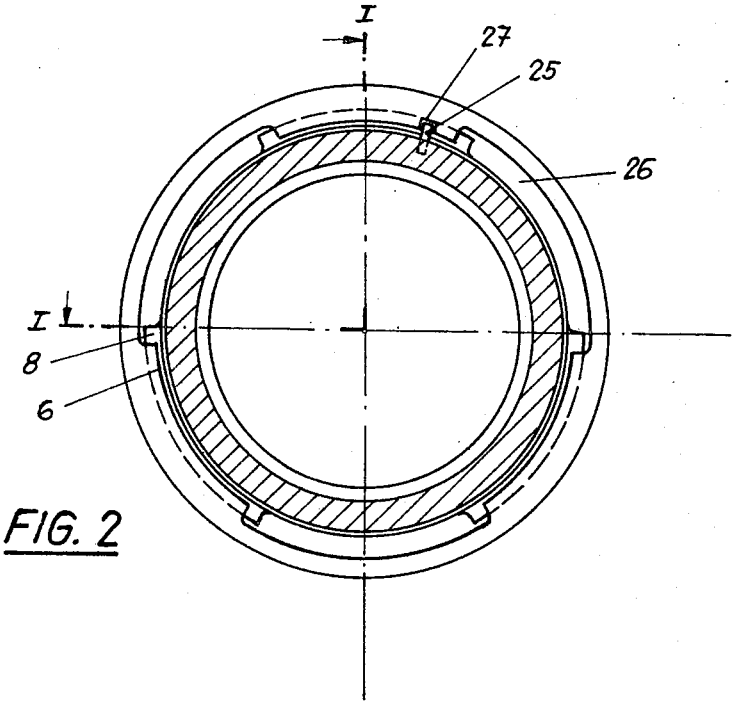

The invention will be described by way of example with reference to the accompanying drawings, wherein:

FIG. 1 is a vertical cross-sectional view through the bearing arrangement for a cylindrical stencil, in which the end ring of a stencil is connected to the bearing tube, or bushing by means of universal joint, in right-angle section, taken along the angled line I—I of FIG. 2; and FIG. 2 is a transverse sectional view along line II—II of FIG. 1, illustrating the camming arrangement of a bayonet connection and ink spill openings located between the cams of the bayonet connection.

A cylindrical stencil 1, only one end portion of which is shown, has an end ring 3 adhesively secured to the end portion 2 thereof. The end ring 3, for example of magnesium, is formed with an inwardly directed flange 4, which merges with a cylindrical portion 5. The cylindrical portion 5 and the edge or end portion 2 of stencil 1 are adhered together. The present invention is directed to overcome problems which arise when this adhesive connection is not exactly transverse to the cylinder axis of the stencil. The terminal part of the cyindrical portion 5 is formed with inwardly extending cam projections 6 (FIG. 2), forming a portion of a bayonet connection. The other portion of the bayonet connection is formed on the circumference of a connecting ring 7. Connecting ring 7 is formed with circumferentially spaced projections 8, facing outwardly, and so located that upon telescoping movement between end ring 3 and connecting ring 7, the cam projections 6, 8 fit, one behind the other, to form a reliable connection between the end ring 3 and the connecting ring 7, holding the end ring 3 and hence the stencil 1 securely coupled to the connecting ring 7. If desired, the projections 6, 8 can be formed with axially extending interengaging bumps and grooves, or recesses, respectively, to snap together.

The connecting ring 7 surrounds a coupling ring 12 which, in turn, surrounds the end portion 9 of a bearing bushing 11 which forms a drive connection for the stencil. The end portion 9 of the bearing bushing is of reduced diameter. The connecting ring 7 and portion 9 form the coupling elements of a universal, or gimbal joint, interconnected by coupling ring 12. The coupling or gimbal ring 12 is connected by means of two diametrically (180°) opposed pins 10 forming a pair of gimbal pins with the connecting ring 7 (see FIG. 1, upper half) and, further, by means of two diametrically located pins 13, offset 90° with respect to the pins 10, and forming another pair of gimbal pins with the end 9 of the bearing bushing 11 — see FIG. 1, lower half which, of course, as previously explained, is 90° offset with respect to the upper half in accordance with the right-angle section line I—I of FIG. 2. The connecting pins 10, 13, respectively, are secured by means of a threaded pin 14 with the coupling ring 12, and the end portion 9 of the bearing bushing 11, respectively. Converting ring 7 and coupling ring 12 are formed with suitable bores 24 to accept the pins 10, 13; the bores are bushed with bearing bushing 16.

The universal, or gimbal connection is assembled by first assembling pins 13 to the coupling ring 12, to connect with the end portion 9, and then by assembling the coupling pins 10 in the coupling ring 12, to then connect with the connecting ring 7. The gimbal suspension, or universal joint is then assembled.

Ink, paste ink, and other contaminating substances are kept away from the universal joint by means of elastic sealing rings 17, 18, for example in the form of O-rings. Ring 17 is located in a groove formed in bushing 11, in order to seal the gap between the coupling ring 7 and the bearing bushing 11; ring 18 is located in the gap 21 between the connecting ring 7 and bearing bushing 11, to seal the gap between the connecting ring 7 and the end portion 9. The ring 7 is preferably formed with an inwardly extending projection, wrapping around the outer side of the coupling ring 12, to simplify sealing problems. Various other solutions to seal the gimbal suspension from outside contaminations are possible, and any sealing arrangement may be used which is sufficiently flexible so that operation of the universal suspension is not inhibited.

The plane of universal suspension, indicated by chain-dotted line 20 in FIG. 1, and extending in line with the axes of the universal joint pins 10, 13, should be as close as possible to the plane which defines the end of the stencil 1, The axis of the bearing bushing 11 will then intersect the axis of the stencil 1 in the plane 20 even if the end ring 3 is not perpendicular to the axis of the stencil 1. Otherwise, the axis of the bushing 11 would move about the axis of the stencil 1 in circular, or elliptical movement (depending on the nature and distortion of the end ring), which leads to imperfect printing due to non-uniform instantaneous circumferential speed of rotary screen stencil 1.

The universal joint of FIG. 1 could be replaced by different types of joints; it is, however, important to provide a connection which reliably transmits rotary movement, that is, is a positive non-slipping rotary connection. Any inaccuracies and non-uniformities in transmission of rotary movement, inherent in some universal joints, will not interfere with proper printing since the deviations from axial transmission of rotary movement are small, due to the small angular deviations which are encountered in actual practice. Such non-uniformities, therefore, do not interfere with quality of resulting print. A homokinetic joint may also be used which is stiff in the direction of the axis of the cylindrical stencil, but permits relative angular changes of the axes of rotation of the stencil and the drive connection, that is, the axis of the bushing 11.

The bayonet connection, previously explained, is desirable but not absolutely necessary; the end ring 3 could, itself, from part of the universal joint coupling. Forming a separate connection, however, by providing a bayonet coupling including the cam projections 6, 8, permits simple and rapid connection of the stencil 1 with the bearing bushing 11. The universal joint coupling is preferably entirely secured to the end portion 9 of the bearing bushing 11. The bayonet coupling can be shaped easily to obtain the further advantage that any ink overrunning over the edge 21 can be removed between the portions 6, 8 of the bayonet coupling by openings 26 formed in the respective coupled elements, to be suitably removed at the outside of the connecting ring 7.

The outside of the connecting ring 7 has an outwardly directed abutment pin 25 (FIG. 1) secured thereto, which engages a groove 27 formed in one of the projecting cams 6 of the cylindrical portion 5 of the end ring 3 secured to the stencil. Upon matching of pins 25 in groove 27, the position of the end ring 3 is fixed with respect to the connecting ring 7, and hence with respect to the bearing bushing 11. Alignment of the end rings, and hence of the stencil with respect to the bearing bushing is necessary to provide for alignment of the pattern on the stencil, that is, of a specific circumferential position, with respect to a circumferential position of the bearing element 11.

Bearing element 11 is driven, by being connected to a spur gear ring 29. It is held by means of a bearing 30, for example a pin bearing, in a housing 28. Drive power is supplied by means of a motor M, connected to a pinion 31, engaging the gear 29, which transmits rotary power to the bushing 11.

Housing 28 is secured to a frame, not shown, of the rotary screen printing press, and closed by a cover 32, secured by means of screws 33. A bearing flange 34 is located in the housing, the bearing flange being formed with a bore 35 in which a geared cylindrical element 36 is rotatably journalled, held in axial position by means of a C-ring 37. A bearing ring 38, secured to the geared sleeve 36 by means of screws 39 holds the ink distribution, or doctor blade apparatus in position (see, for example, U.S. Pat. No. 3,557,690). The other end of the stencil 1 is secured in a bushing 11 similar to that explained in connection with FIG. 1, and likewise journalled in the housing or frame of the screen printing machine. The bearing bushing 11 can be driven from one side only, or from both sides, depending on the axial length and the nature of the stencil. The same motor, with a double-ended shaft, can drive the two ends of the stencil, over gearing 31, 29, similar to that shown for one side of the stencil only.

The thin, fragile and sensitive stencils are carefully, and gently used, during the printing operation, by relieving or avoiding torsional or other stresses thereon by the universal suspension, thereby substantially increasing the life of the stencils. The axial strain on the stencil itself is uniformly distributed throughout the stencil, also during printing, that is, during rotation by permitting deflection of the end suspension due to the universal joint connection.

Various changes and modifications may be made within the scope of the inventive concept.

I claim:

1. A rotary printing press, having at least one cylindrical stencil (1) and end rings (3) secured to the axial ends thereof, a rotary drive connection and attachment means to secure the cylindrical stencil (1) by its end rings (3) to the drive connection comprising a universal joint (7, 9, 10, 11, 12, 13, 14) interposed between the drive connection and at least one of the end rings (3) of the stencil (1) and having a plane of movement transverse to the axis of rotation of the rotary drive connection which is immediately adjacent to a plane defined by the respective ends of the stencil (1);

the universal joint comprising a connecting ring (7) to which the respective end ring (3) of the stencil is secured; and a gimbal structure having a coupling ring (12) and radially extending connecting pairs of gimbal pins (10,13), the pairs of gimbal pins being offset by 90° with respect to each other, one of said gimbal pin pairs (13) movably connecting the respective end (9) of the drive connection with the gimbal ring (12) and the other of said gimbal pin pairs (10) movably connecting said gimbal ring (12) with the connecting ring (7).

2. Screen printing press according to claim 1, wherein the connecting ring (7) and the respective end ring (3) of the stencil are formed with interengaging locking means; and interengaging pin (25) and groove (27) means formed in the connecting ring (7) and the respective end ring (3), respectively, to locate the end ring in predetermined angular aligned position with respect to the connecting ring.

3. Screen printing press according to claim 2, wherein the interengaging locking means comprises a bayonet connection including projecting cams (6, 8) and wherein the respective rings (3, 7) are formed with aligned slots to provide for fluid communication between the inside of the stencil and the outside of the drive connection (11) and the outside of the universal joint, to permit escape of excess fluid from the inside of the stencil without contamination of the universal joint.

4. Screen printing press according to claim 1, further comprising sealing means (17, 18) to prevent contamination of the universal joint and entry of foreign substances therein, wherein the connecting ring (7) is located diametrically outwardly of, surrounding and overlapping the coupling ring (12), the sealing means sealing the connecting ring (7) to the drive connection (11) to protect the coupling ring (12).

5. Screen printing press according to claim 4, wherein the sealing means comprises elastic sealing rings (17, 18).

* * * * *